US010363564B2

(12) United States Patent
Bianca et al.

(10) Patent No.: US 10,363,564 B2
(45) Date of Patent: Jul. 30, 2019

(54) SYSTEM, METHOD AND APPARATUS FOR CONTROLLING THE FLOW DISTRIBUTION OF SOLID PARTICLES

(71) Applicant: GENERAL ELECTRIC TECHNOLOGY GMBH, Baden (CH)

(72) Inventors: Joseph David Bianca, Southampton, MA (US); Paul John Chapman, Windsor, CT (US); Timothy Joseph Braun, Marlborough, CT (US)

(73) Assignee: General Electric Technology GmbH, Baden (CH)

( * ) Notice: Subject to any disclaimer, the term of this patent is extended or adjusted under 35 U.S.C. 154(b) by 736 days.

(21) Appl. No.: 15/056,122

(22) Filed: Feb. 29, 2016

(65) Prior Publication Data

US 2017/0246644 A1 Aug. 31, 2017

(51) Int. Cl.

| | |
|---|---|
| ***B02C 23/10*** | (2006.01) |
| ***B02C 23/30*** | (2006.01) |
| ***B02C 15/00*** | (2006.01) |
| ***B02C 23/32*** | (2006.01) |
| ***B02C 23/08*** | (2006.01) |
| ***B02C 23/12*** | (2006.01) |
| ***B07B 7/086*** | (2006.01) |

(52) U.S. Cl.

CPC ..... *B02C 23/10* (2013.01); *B02C 15/00* (2013.01); *B02C 15/007* (2013.01); *B02C 23/08* (2013.01); *B02C 23/12* (2013.01); *B02C 23/30* (2013.01); *B02C 23/32* (2013.01); *B07B 7/086* (2013.01); *B02C 2015/002* (2013.01)

(58) Field of Classification Search

CPC ..... B02C 23/30; B02C 23/10; B02C 23/12; B02C 23/32; B02C 15/00; B02C 15/007; B02C 15/002; B02C 2015/002; B07B 7/086

USPC ..... 241/117–121, 79.1, 52

See application file for complete search history.

(56) References Cited

U.S. PATENT DOCUMENTS

| | | | | |
|---|---|---|---|---|
| 2,868,462 | A * | 1/1959 | Bogot | B02C 15/04 209/139.2 |
| 6,257,415 | B1 | 7/2001 | Wark | |
| 6,607,079 | B2 | 8/2003 | Laux | |
| 7,549,382 | B2 | 6/2009 | Levy et al. | |
| 8,136,746 | B2 | 3/2012 | Martin et al. | |
| 8,181,584 | B2 | 5/2012 | Bilirgen et al. | |
| 2003/0034278 | A1 * | 2/2003 | Laux | B02C 23/32 209/143 |
| 2004/0206279 | A1 * | 10/2004 | Wark | F23K 3/02 110/104 R |

(Continued)

OTHER PUBLICATIONS

International Search Report and Written Opinion issued in connection with corresponding PCT Application No. PCT/EP2017/054657 dated Jun. 9, 2017.

*Primary Examiner* — Kenneth E Peterson
*Assistant Examiner* — Nhat Chieu Q Do
(74) *Attorney, Agent, or Firm* — Juergen Hoffman; Hoffman Warnick LLC

(57) ABSTRACT

A turret includes a generally frusto-conical shaped body and a plurality of static vanes arranged interior to the body and extending inwardly from an interior sidewall of the body. The vanes are configured to guide a swirling flow of solid particles as they enter the body, and to divide the swirling flow into a plurality of controlled flows that are communicated to a plurality of coal outlet pipes.

2 Claims, 8 Drawing Sheets

(56) References Cited

U.S. PATENT DOCUMENTS

| | | | |
|---|---|---|---|
| 2012/0243969 | A1 | 9/2012 | Lin et al. |
| 2014/0203121 | A1 | 7/2014 | Latta et al. |

* cited by examiner

SYSTEM, METHOD AND APPARATUS FOR CONTROLLING THE FLOW DISTRIBUTION OF SOLID PARTICLES

BACKGROUND

Technical Field

Embodiments of the invention relate to pulverized coal boilers and, more particularly, to a system, method and apparatus for controlling the flow distribution of coal between outlet pipes of a pulverizer.

Discussion of Art

Coal fired boilers utilize pulverizers to grind coal to a desired fineness so that it may be used as fuel for burners. In a typical pulverized coal boiler, coal particulate and primary air flow from the pulverizers to the burners through an array of coal pipes leading from the pulverizers to the burners. Typically, raw coal is fed through a central coal inlet at the top of the pulverizer and falls by gravity to the grinding area at the base of the mill. Once ground using one or more of a variety of known methods, the pulverized coal is transported upwards using air as the transport medium. The pulverized coal passes through classifier vanes within the pulverizer. These classifier vanes may vary in structure, but are intended to establish a swirling flow within the classifier and rejects cone to prevent coarse coal particles from flowing into the discharge turret of the pulverizer. The centrifugal force field set up in the rejects cone forces the coarse coal particles to drop back down onto the grinding surface to be reground until the desired fineness is met. Once the coal is ground finely enough, it is discharged from the pulverizer and distributed among multiple pulverized coal outlet pipes and into respective fuel conduits where it is carried to the burners.

With reference to FIG. 1, in a conventional coal pulverizer 10, raw coal is fed into a coal inlet pipe and by force of gravity falls through a centrally located coal chute 12 until it reaches a grinding platform 14 where a grinding mechanism 16 grinds the coal into fine pieces. Air flows into an air inlet port 18, feeding primary air into the pulverizer 10. This creates a stream of air that carries the particles of pulverized coal upward from the grinding platform 14 where they enter classifier vanes 20 of a classifier 22 that establish a swirling flow within the classifier and a reject cone 24. The centrifugal force set up in the reject cone 24 prevents coarse pieces of coal from entering the discharge turret 26, as discussed above. The coarse pieces of coal fall by force of gravity back into the grinding platform 14, to be reground by the grinding mechanism 16 until they reach a desired degree of fineness. The pulverized coal that is not too coarse, however, is directed by the swirling flow of air upwards through a deflector ring 28 of the classifier 22, and into the discharge turret 26 located above the deflector ring 28. Once the pulverized coal enters the discharge turret 26 it is distributed between the multiple pulverized coal outlet pipes 30 (FIG. 1 shows seven pulverized coal outlet pipes at the top of the turret 26). The pulverized coal is then carried by connected fuel conduits (not shown) to a boiler where it is burned as fuel.

While the swirling flow of pulverized coal is efficient in preventing coarse coal particles from being carried upward to the coal pipes, such swirling flow has also been known to create an imbalance in coal flow distribution between the coal pipes 30. As illustrated by the particle tracking diagrams of FIGS. 2-4, the swirling flow created in the classifier 22 also extends into the deflector ring 28 and the turret 26, leading to an imbalanced distribution of coal between the various pipes 30. In particular, as shown in FIGS. 2 and 3, the trajectory 32 of coal particles within the deflector ring 38 has a substantially horizontal component, and only a slight vertical component. The same is true for the trajectory 34 of coal particles within the turret 26. This has been shown to lead to a greater distribution of coal into some of the pipes as compared to others (see, e.g., FIG. 3, where the coal pipe at the bottom right receives a lesser flow of coal particles as compared to the others).

This unbalanced distribution of coal among the coal outlet pipes can adversely affect the performance of each burner and the boiler as a whole and can lead to decreased combustion efficiency, increased potential for tube fouling, furnace slagging, and non-uniform heat release within the combustion chamber. In addition, unbalanced distribution of coal can also result in the inability to control individual burner stoichiometry (i.e., the air-to-coal ratio), which can lead to elevated emissions of nitric oxides, carbon monoxide and the like.

In view of the above, there is a need for a system and method for ensuring a more uniform distribution of coal between the various outlet pipes of a pulverizer in order to improve overall system efficiency and performance.

BRIEF DESCRIPTION

In an embodiment, a turret for a pulverizer is provided. The turret includes a generally frusto-conical shaped body and a plurality of static vanes arranged interior to the body and extending inwardly from an interior sidewall of the body. The vanes are configured to guide a swirling flow of solid particles as they enter the body, and to divide the swirling flow into a plurality of controlled flows that are communicated to a plurality of coal outlet pipes.

In another embodiment, a method for controlling the output of coal in a plurality of coal outlet pipes in a coal pulverizer is provided. The method includes the steps of modifying, or retrofitting, a portion of a coal pulverizer with a turret, the turret comprising a generally frusto-conical shaped body and a plurality of static vanes arranged interior to the body and extending inwardly from an interior sidewall of the body.

In yet another embodiment, a coal pulverizer is provided. The coal pulverizer includes a grinding mechanism configured to transform raw coal into pulverized coal, a classifier configured to receive the pulverized coal from the grinding platform and to generate a swirling flow of coal, the classifier being further configured to reject coarse particles of the pulverized coal from the swirling flow, a turret arranged generally above the classifier, the turret having a generally frusto-conical body and a plurality of static vanes arranged interior to the body and extending inwardly from an interior sidewall of the body, and a plurality of coal outlet pipes in fluid communication with the interior of the turret. The vanes of the turret configured to guide a swirling flow of coal as it enters the turret, and to divide the swirling flow into a plurality of controlled flows that are communicated to a plurality of coal outlet pipes.

DRAWINGS

The present invention will be better understood from reading the following description of non-limiting embodiments, with reference to the attached drawings, wherein below:

DETAILED DESCRIPTION

Figure 1:
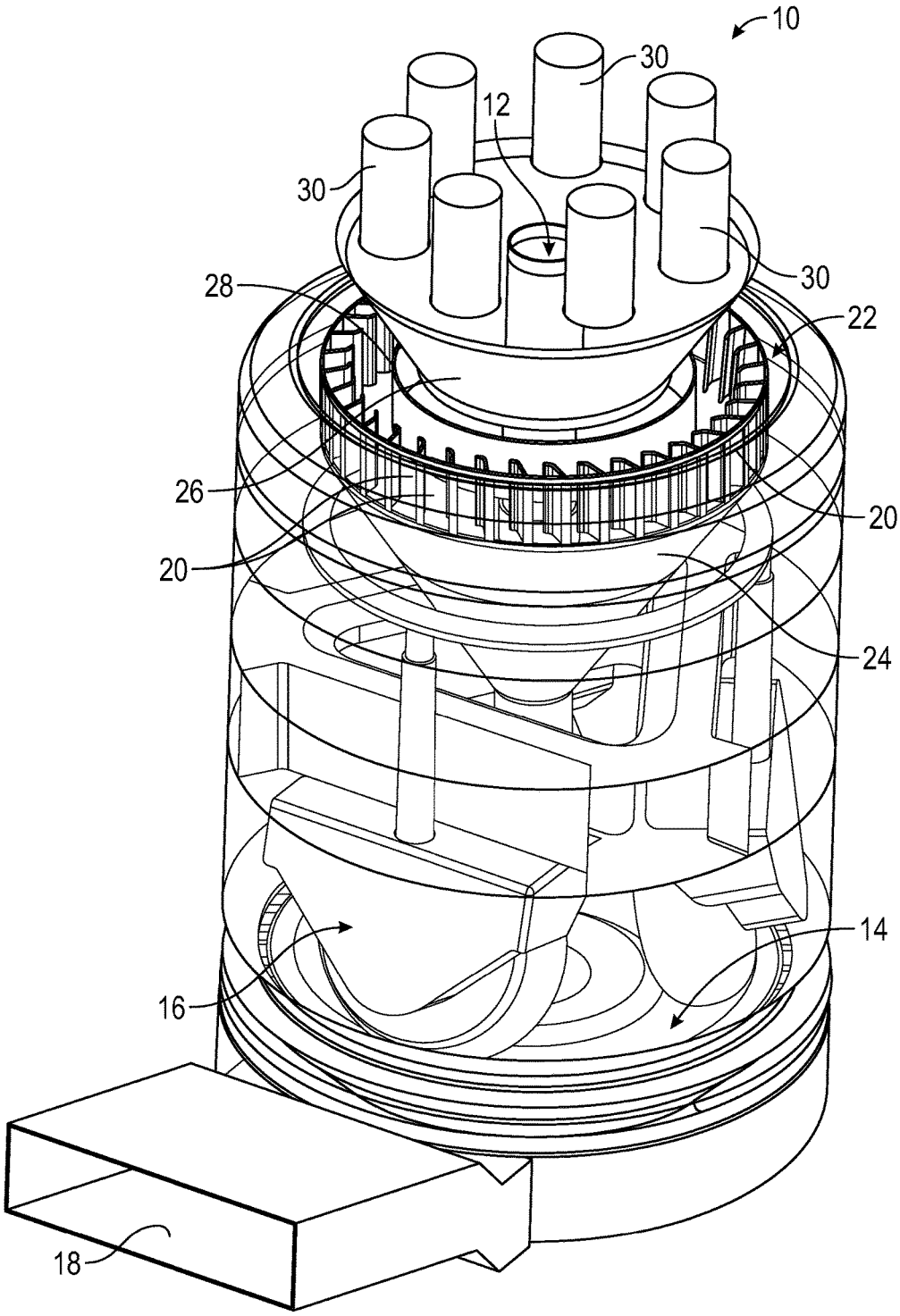
FIG. 1 (Prior Art)
FIG. 1 is a perspective view of a coal pulverizer or mill of the prior art.

Reference will be made below in detail to exemplary embodiments of the invention, examples of which are illustrated in the accompanying drawings. Wherever possible, the same reference characters used throughout the drawings refer to the same or like parts. While embodiments of the invention are directed to systems and methods for controlling the flow distribution of pulverized coal in a pulverizer and, in particular, for controlling the flow distribution of coal to burner coal pipes on front and rear fired boilers, embodiments of the invention may be also applicable to controlling the flow distribution of coal to burner coal pipes on any type of boiler, and to controlling the flow of solid particles, generally.

As used herein, "operatively coupled" refers to a connection, which may be direct or indirect. The connection is not necessarily being a mechanical attachment. As used herein, "fluidly coupled" or "fluid communication" refers to an arrangement of two or more features such that the features are connected in such a way as to permit the flow of fluid between the features and permits fluid transfer.

Figure 4:
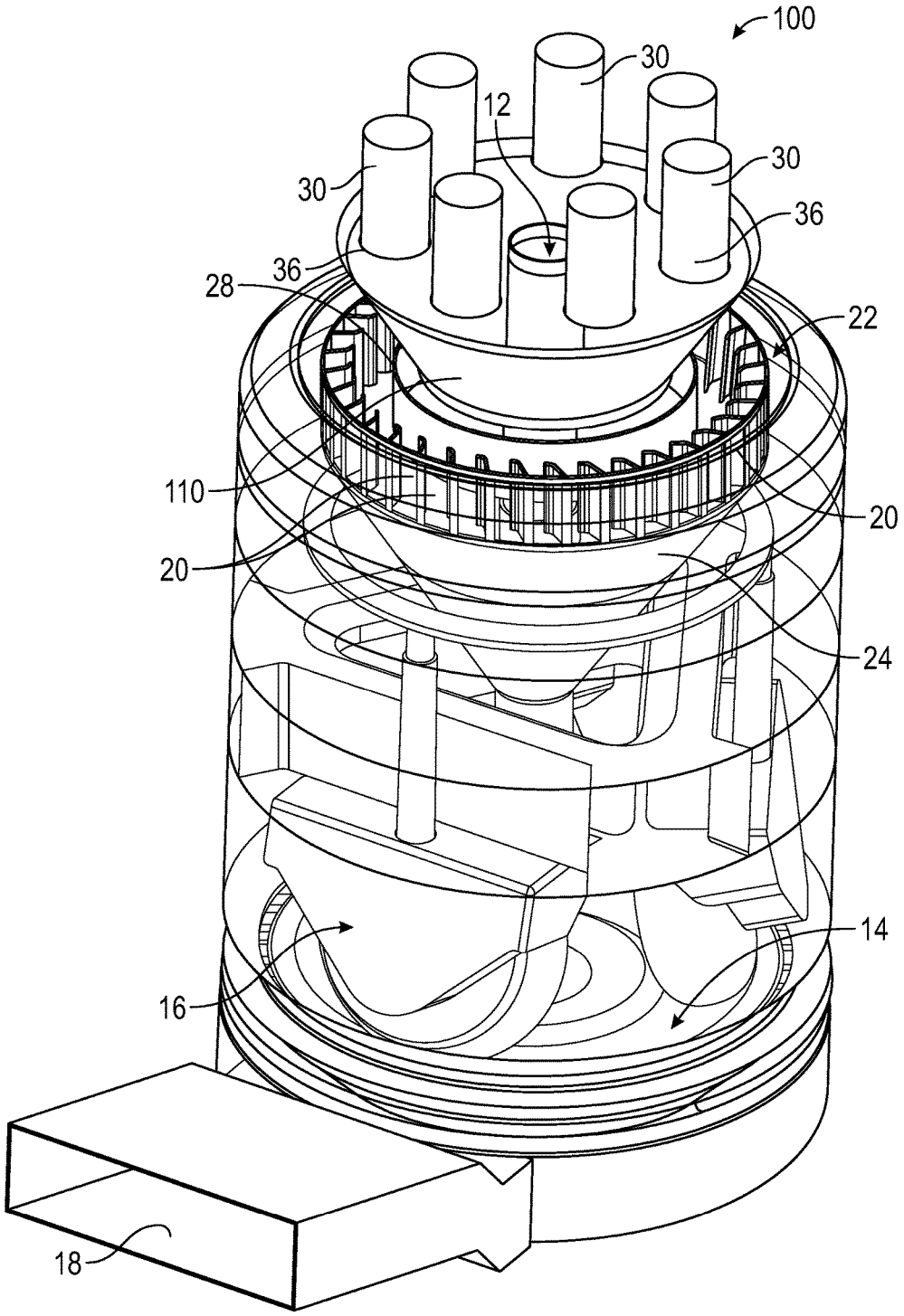
FIG. 4 is a perspective view of a coal pulverizer or mill according to an embodiment of the invention.

Embodiments of the invention relate to a system and method for controlling the flow distribution of solid particles, namely coal, in a pulverizer or mill for a coal fired boiler. As illustrated in FIG. 4, a pulverizer 100 according to an embodiment of the present invention is generally similar in configuration to pulverizer 10 described above, where like reference numerals designate like parts. The pulverizer 100 includes a coal chute 12 configured to receive a supply of raw coal and to feed the coal, by force of gravity, to a grinding platform or table 14. At the grinding platform 14, a grinding mechanism 16 of any known type and configuration is operable to grind the raw coal into fine particles. Arranged above the grinding platform 14 is a classifier 22 having a plurality of vanes 20 arranged in an annular ring above a reject cone 24. As illustrated in FIG. 4, the classifier 22 also includes a deflector ring 28 defining an annular or cylindrical body concentrically arranged within the annular ring of vanes 20 and through which the coal chute 12 extends. A turret 110 is fluidly coupled to the classifier 22 (through the passageway defined by the deflector ring 28) and is positioned thereabove. The turret 110 defines a generally conical shaped or frusto-conical shaped body having a plurality of outlets 36 at the top thereof. The outlets 36 are in fluid communication with a corresponding number of outlet pipes, such as coal outlet pipes 30, that lead to fuel conduits (not shown) configured to carry pulverized coal to the burners of the boilers for combustion. The coal chute 12 extends through the turret 110 to allow raw coal to pass therethrough to the grinding platform 14.

In an embodiment, the classifier 22 is a static classifier. In other embodiments, the classifier 22 may be a dynamic classifier. In an embodiment, the vanes 20 of the classifier 22 may be selectively adjustable in order to control the relative fineness or coarseness of coal particles according to system operating parameters. For example, one or more of the vanes 20 may be pivotable about a vertical axis.

Figure 5:
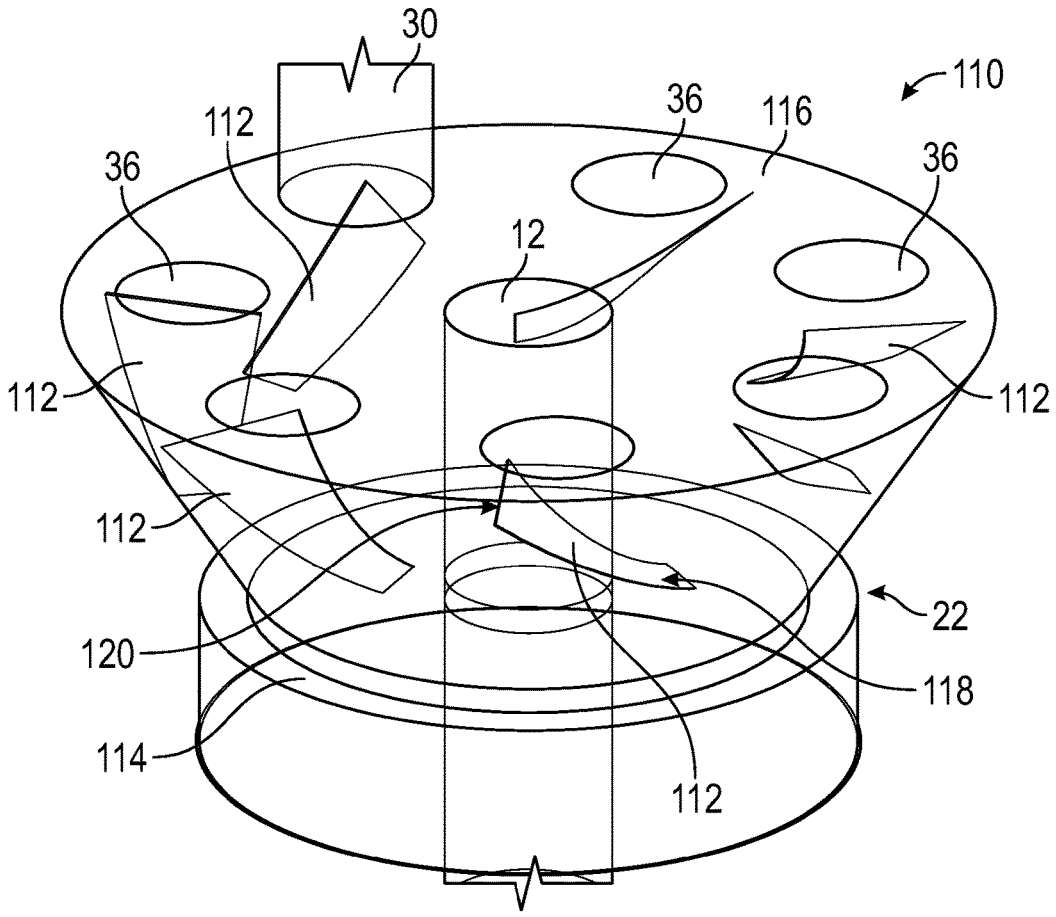
FIG. 5 is a detail, perspective view of a turret section of the coal pulverizer of FIG. 4, according to an embodiment of the invention.

Turning now to FIG. 5, the turret 110 according to one embodiment of the invention is more clearly illustrated. The turret 110 includes a plurality of vanes or baffles 112 that project inwardly from the tapered interior sidewalls of the turret 110 and which are tangent to the tapered sidewalls of the turret 110. The vanes 112 extend generally from the bottom 114 of the turret 110 to the top 116 of the turret 110 at an angle, as indicated below. In an embodiment, the vanes 112 extend from about 3 inches from the bottom 114 of the turret 110 to the top 116 of the turret 110. In other embodiments, the vanes 112 may extend from a general midpoint of the turret 110 to the top 116 of the turret 110. As shown in FIG. 5, the vanes 112 are generally arcuate in shape and each have a leading edge 118 that is oriented substantially horizontally, and a trailing edge 120 that is oriented generally vertically. The vanes 112 therefore each define a generally arcuate body that curves upward from the leading edge 118 to the trailing edge 120 and has a twisted shape, terminating at the back of a respective outlet pipe 30, below the top 116 of the turret 110. In an embodiment, the pitch of the vanes 112 is set to coincide with the flow of the air and coal particle flow within the turret, approximately 65 degrees from horizontal. In an embodiment, the vanes 112 have a generally tapered shape (resulting from a constant interior radius along the height of the turret), such that vanes 112 are narrower at the leading edge 118 and wider at the trailing edge 120. As shown in FIG. 5, the vanes 112 do not contact the coal chute 12 that extends through the turret 110.

In an embodiment, the vanes 112 are static vanes, meaning that they are in fixed position within the turret 110 and unable to rotate about any axis. In an embodiment, the number of vanes 112 corresponds to the number of outlets 36 and coal pipes 30 fluidly coupled to the turret 110. For example, as illustrated in FIG. 5, the turret 26 may include seven vanes 112 corresponding to the seven outlets 36 in the turret 110. While seven vanes 112 are illustrated in FIG. 5, it is envisioned that the number of vanes 112 within the turret 110 will be dictated by the number of outlets 36 in the turret 110, which may vary between applications or installations.

In operation, raw coal is fed into the coal inlet pipe and by force of gravity falls through the centrally located coal chute 12 until it reaches the grinding platform 14 where the grinding mechanism 16 grinds the coal into fine pieces. Air flows into an air inlet port 18 below the grinding platform 14, feeding primary air into the pulverizer 100. This creates a stream of low-velocity air that carries the particles of pulverized coal upward from the grinding platform 14 where they enter the classifier vanes 20 of the classifier 22. These vanes 20 establish a swirling flow within the reject cone 24. The centrifugal force set up in the reject cone 24 prevents coarse pieces of coal from entering the discharge turret 110. In particular, coarse pieces of coal fall by force of gravity back into the grinding platform 14, to be reground by the grinding mechanism 16 until they reach a desired degree of fineness. The pulverized coal that is not too coarse, however, is carried by the swirling flow of air upwards through the deflector ring 28 of the classifier 22 and into the turret 110. In particular, the pulverized coal that is not rejected passes upwards into the turret 110 and is guided by the vanes 112 into the coal outlet pipes 30 associated with each section. The pulverized coal may then be fed to one or more burners where it is combusted.

Figure 2:
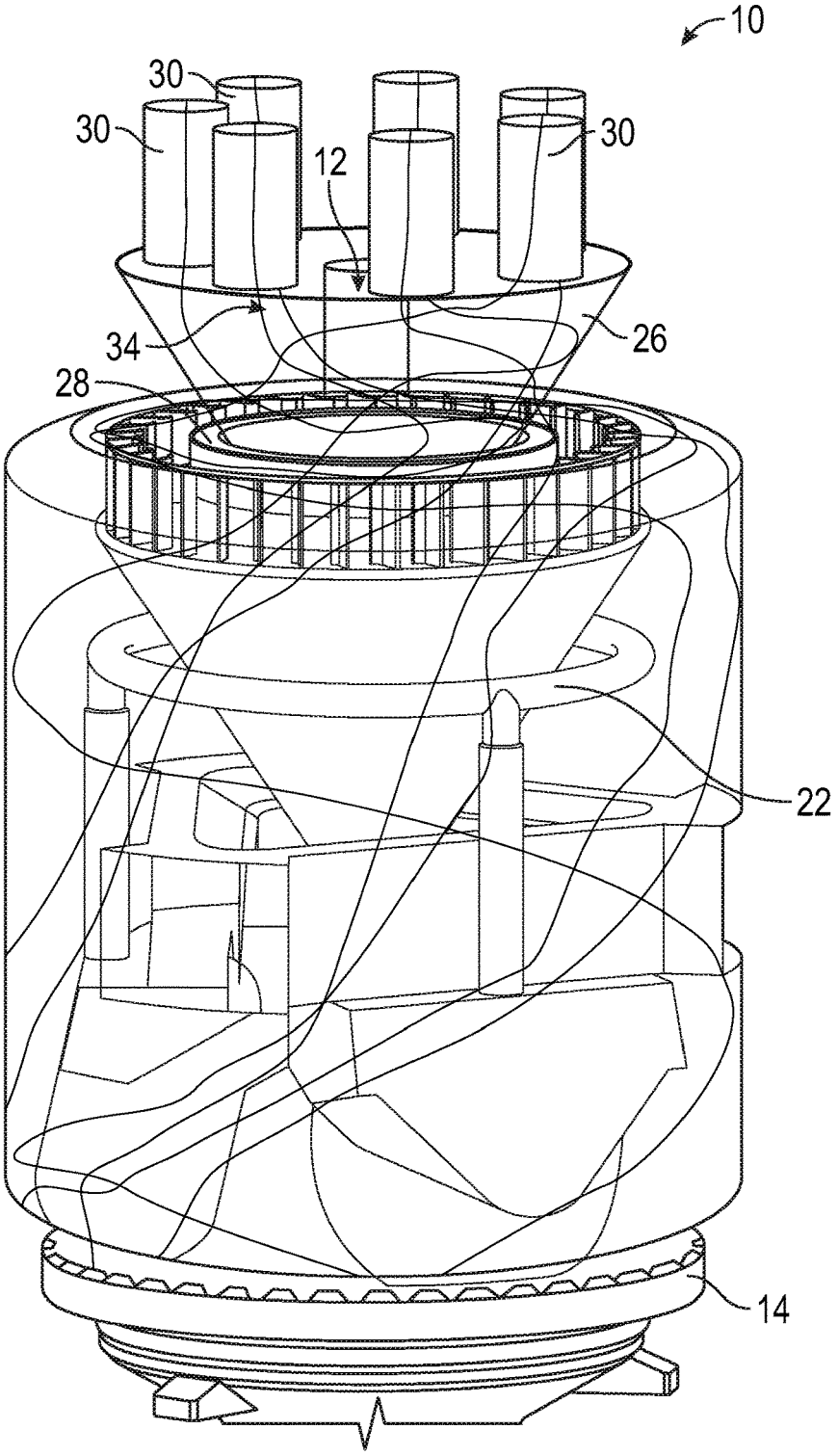
FIG. 2 (Prior Art)
FIG. 2 is a detail, perspective view of an upper portion of the coal pulverizer of FIG. 1, showing the travel of coal particles.
Figure 3:
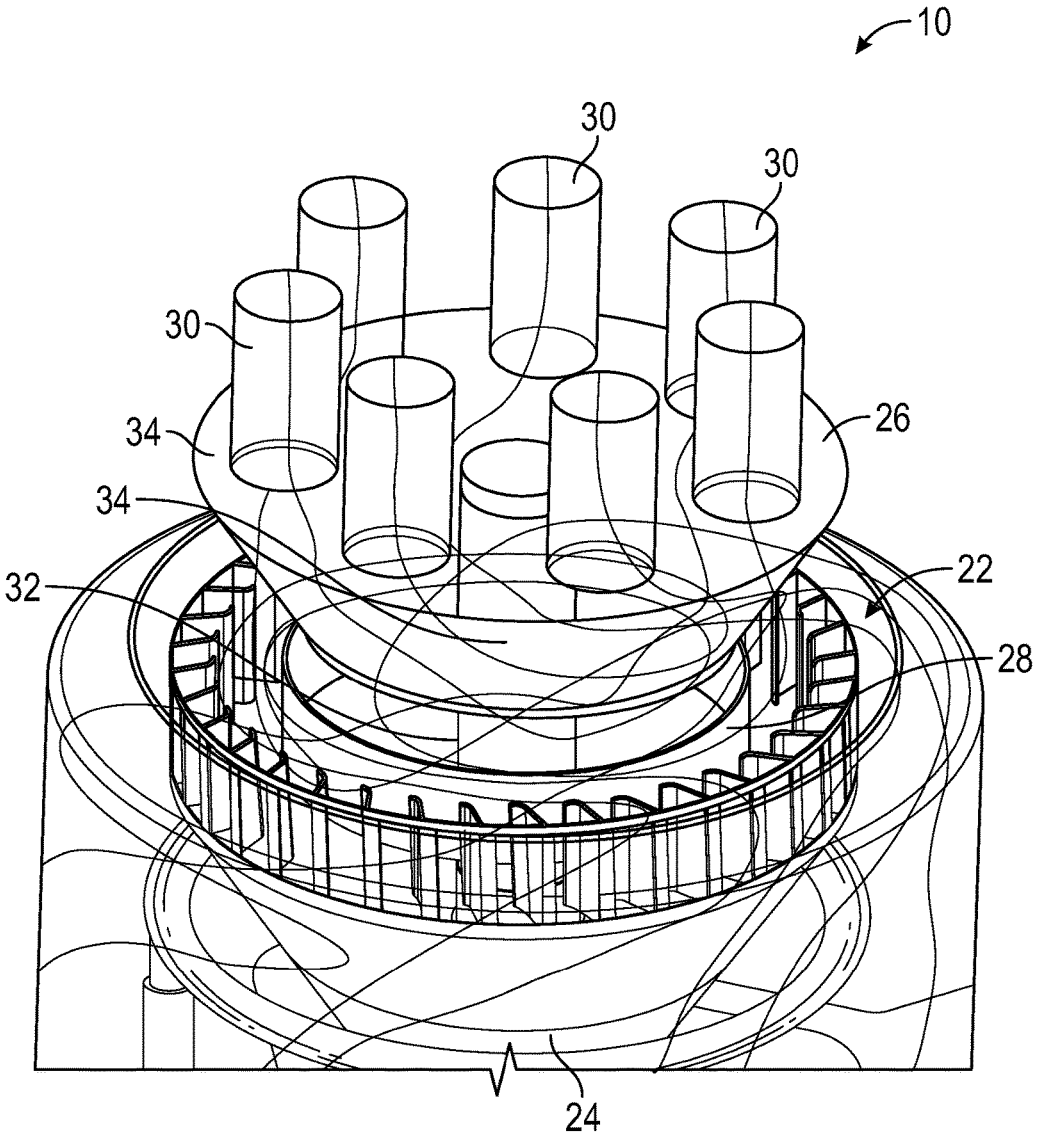
FIG. 3 (Prior Art)
FIG. 3 is a detail, perspective view of a classifier and turret of the coal pulverizer of FIG. 1, showing the travel of coal particles within the classifier, turret and outlet pipes.
Figure 6:
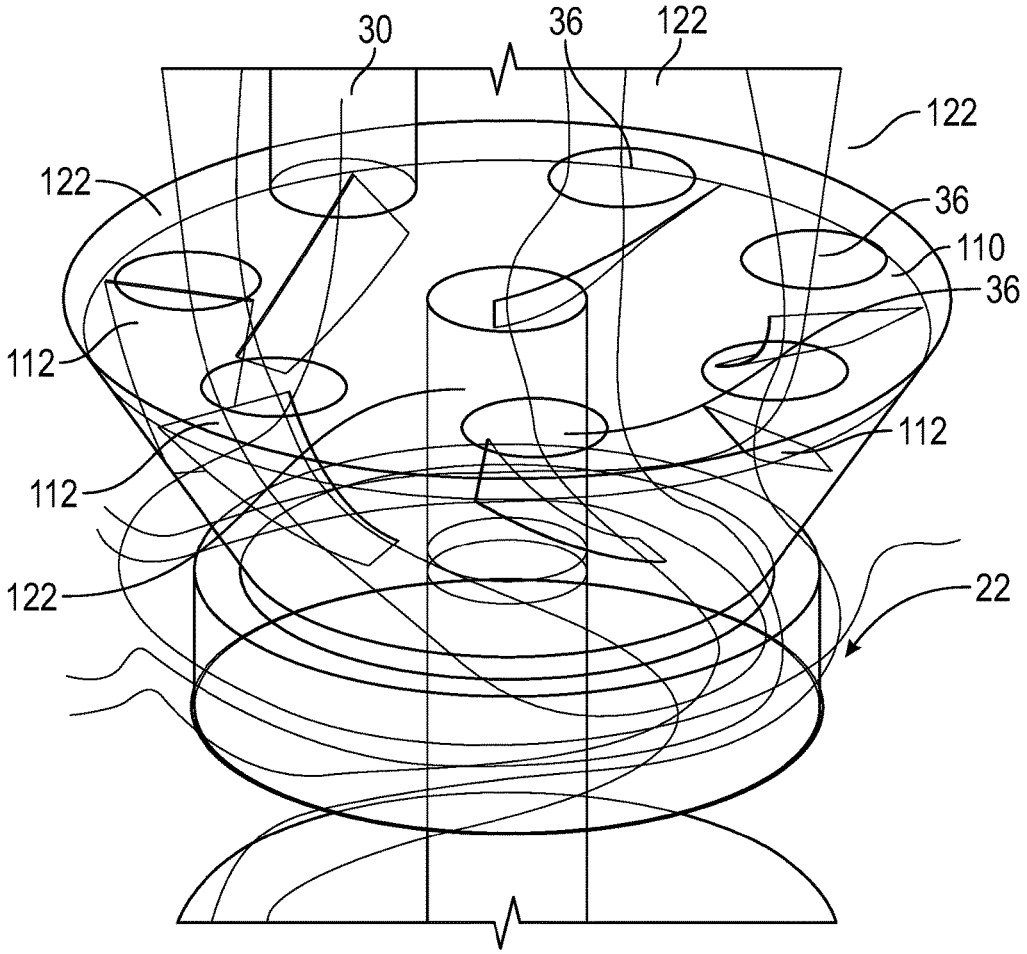
FIG. 6 is a detail, perspective view of the turret section of FIG. 5, showing the travel of coal particles within the turret.

As best shown in FIG. 6, the vanes 112 within the turret 110 function to uniformly divide or partition the swirling flow of coal into a plurality of equal flows (e.g., coal flows 122) that are guided by the twisted shape of the vanes 112 into the respective coal outlet pipes 30. As shown therein, the angle and twisted shape of the vanes 112 is designed to match the swirling particle flow as it enters the turret 110 from below (e.g., the particle flow at the inlet of the turret has a generally horizontal trajectory in many cases, and the horizontally oriented leading edge 118 and curvature of the vanes 112 is designed to match this trajectory). The vanes 112 therefore function to match the direction of flow as it enters the turret 110, and to gently guide the flow equally into the respective coal outlet pipes 30 associated with each vane 112. This separation and guiding of the coal flow (i.e., bringing it back within a controllable and predictable range), and the even distribution of the flow to the outlets 36 via use of static vanes 112 within the turret 110 (see FIG. 6) is an improvement over the prior art, where flow control of the pulverized coal has proven difficult because of the swirling within the deflector ring and turret, and which has heretofore contributed to an imbalance between the respective coal pipes 30 (see FIGS. 2 and 3).

Figure 7:
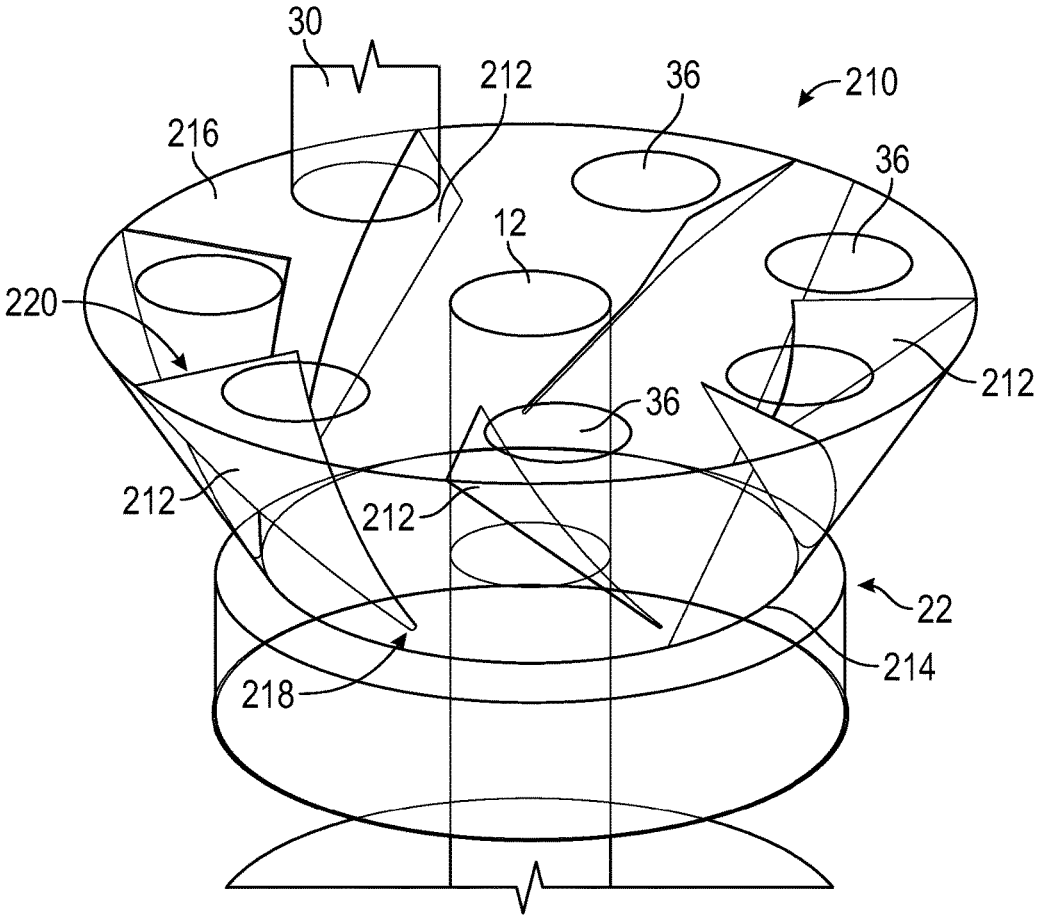
FIG. 7 is a detail, perspective view of a turret section of the coal pulverizer according to another embodiment of the invention.

Referring now to FIG. 7, a turret 210 according to another embodiment of the invention is shown. The turret 210 is substantially similar to turret 110 described above, and includes a plurality of vanes or baffles 212 that project inwardly from the tapered interior sidewalls of the turret 210 and which are tangent to the tapered sidewalls of the turret 210. The vanes 212 extend from the bottom 214 of the turret 210 to the top 216 of the turret 210 (in contrast to vanes 112 of turret 110 which were located some distance above the bottom of the turret 110). As shown in FIG. 7, the vanes 212 are generally arcuate in shape and each have a leading edge 218 that is oriented substantially horizontally, and a trailing edge 220 that is oriented generally vertically. The vanes 212 therefore each define a generally arcuate body that curves upward from the leading edge 218 to the trailing edge 220 and has a twisted shape, terminating at the back of a respective outlet pipe 30, below the top 216 of the turret 210. In an embodiment, the pitch of the vanes 212 is approximately 65 degrees from horizontal. In an embodiment, the vanes 212 have a generally tapered shape (resulting from a constant interior radius along the height of the turret), such that vanes 212 are narrower at the leading edge 218 and wider at the trailing edge 220. As shown in FIG. 7, the vanes 212 do not contact the coal chute 12 that extends through the turret 210.

Comparing the vanes 212 of turret 210 shown in FIG. 7 to the vanes 112 of turret 110 shown in FIG. 5, the vanes 212 are much narrower at the leading edge 218 than vanes 112. In particular, the leading edge 218 of vanes 212 almost comes to a point. In an embodiment, this configuration may contribute to a more gradual transition of the swirling flow to the vertical flow entering the coal outlet pipes 30, resulting in a more controlled flow and even flow distribution.

Figure 8:
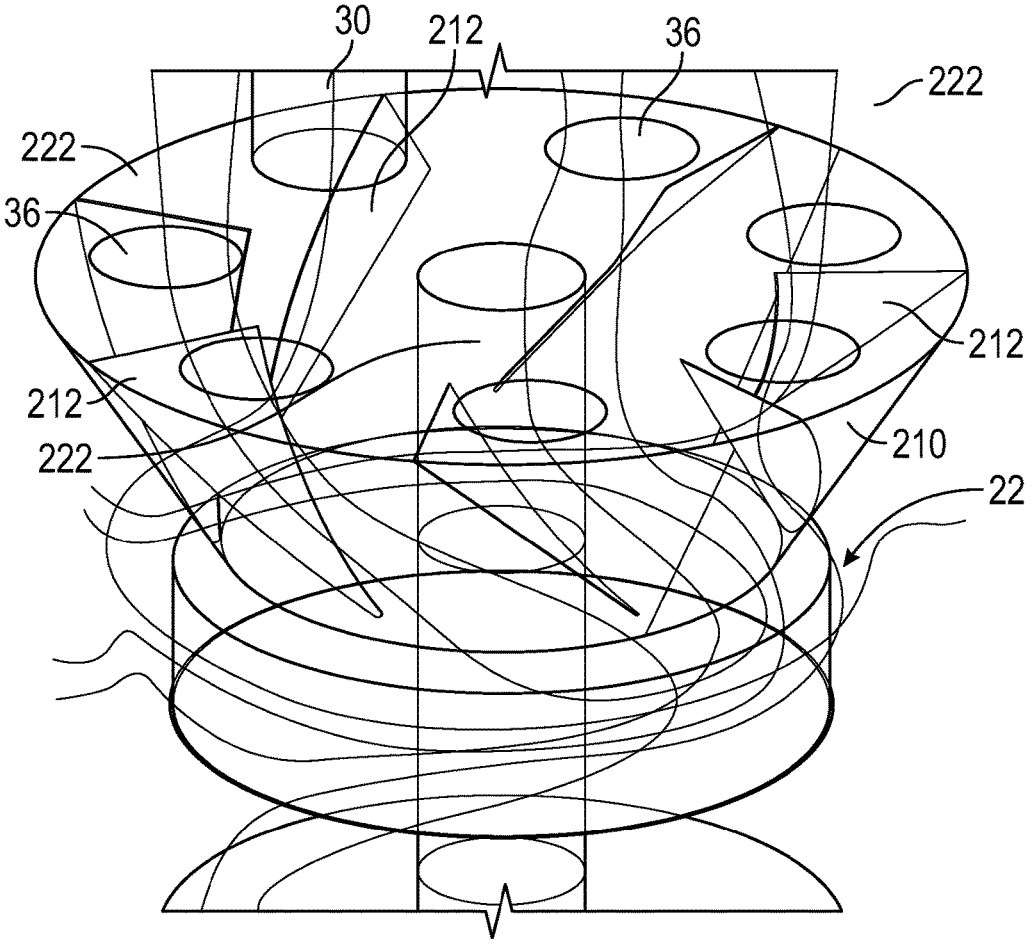
FIG. 8 is a detail, perspective view of the turret section of FIG. 7, showing the travel of coal particles within the turret.

As with vanes 112 of turret 110, the vanes 212 of turret 210 function to uniformly divide or partition the swirling flow of coal into a plurality of equal flows (e.g., coal flows 222) that are guided by the twisted shape of the vanes 212 into the respective coal outlet pipes 30, as shown in FIG. 8. As shown therein, the angle and twisted shape of the vanes 212 is designed to match the swirling particle flow as it enters the turret 210 from below (e.g., the particle flow at the inlet of the turret has a generally horizontal trajectory in many cases, and the horizontally oriented leading edge 218 and curvature of the vanes 212 is designed to match this trajectory). The vanes 212 therefore function to match the direction of flow as it enters the turret 210, and to gently guide the flow equally into the respective coal outlet pipes 30 associated with each vane 212. This separation and guiding of the coal flow (i.e., bringing it back within a controllable and predictable range), and the even distribution of the flow to the outlets 36 via use of static vanes 212 within the turret 210 (see FIG. 8) is an improvement over the prior art, where flow control of the pulverized coal has proven difficult because of the swirling within the deflector ring and turret, and which has heretofore contributed to an imbalance between the respective coal pipes 30 (see FIGS. 2 and 3).

In an embodiment, the use of static, tapered and twisted flow guiding vanes within the turret may improve pipe-to-pipe coal flow balance to approximately +/−10% or better, and in some cases to approximately +/−5% or better, as compared to a pipe-to-pipe imbalance of over 30% in some cases with existing systems. As indicated above, by uniformly distributing the flow of coal among each of outlets 36 in the turret utilizing static, curved vanes within the turret 110, furnace fouling and slagging may be minimized, emissions decreased and combustion efficiency increased, which leads to improved boiler efficiency and better overall performance as compared to existing systems.

In an embodiment, the pulverizer 100 may be manufactured with the turret 110, 210 having the vanes 112, 212 installed therein. In other embodiments, the turret 110 or 210 having vanes 112 or 212 may be manufactured as a separate component that may be retrofit into existing pulverizers. In yet other embodiments, existing pulverizers, and turrets thereof, may be retrofit with static vanes for improving the flow distribution of coal to the outlet pipes connected thereto. In this respect, the invention can be integrated into new power plant installations, as well as retrofit into the pulverizers of existing power generation systems. As a result, improved boiler efficiencies and decreased emissions may be realized, regardless of whether a new plant is being brought online, or an existing plant updated or upgraded.

In an embodiment, a turret for a pulverizer is provided. The turret includes a generally frusto-conical shaped body and a plurality of static vanes arranged interior to the body and extending inwardly from an interior sidewall of the body. The vanes are configured to guide a swirling flow of solid particles as they enter the body, and to divide the swirling flow into a plurality of controlled flows that are communicated to a plurality of coal outlet pipes. In an embodiment, the number of vanes is equal to the number of coal outlet pipes in the pulverizer. In an embodiment, each of the vanes includes a body having a leading edge and a trailing edge. The leading edge is located adjacent to a bottom of the turret and the trailing edge is located adjacent to a top of the turret and a respective one of the coal outlet pipes. In an embodiment, the body of each of the vanes has a generally twisted shape. In an embodiment, the twisted shape of the body of the vanes at the leading edge is configured to generally match the flow of solid particles at the bottom of the turret. In an embodiment, the leading edge is narrower than the trailing edge. In an embodiment, a pitch angle of each of the vanes is approximately 65 degrees from horizontal. In an embodiment, the solid particles are pulverized coal particles.

In another embodiment, a method for controlling the output of coal in a plurality of coal outlet pipes in a coal pulverizer is provided. The method includes the steps of modifying, or retrofitting, a portion of a coal pulverizer with a turret, the turret comprising a generally frusto-conical shaped body and a plurality of static vanes arranged interior to the body and extending inwardly from an interior sidewall of the body. In an embodiment, each of the vanes includes a body having a leading edge and a trailing edge. The leading edge is located adjacent to a bottom of the turret and the trailing edge is located adjacent to a top of the turret and a respective one of the coal outlet pipes. The turret is positioned in an upper portion of the pulverizer above a classifier of the pulverizer and is in fluid communication with the classifier. In an embodiment, the body of each of the vanes has a generally twisted shape. In an embodiment, the leading edge is narrower than the trailing edge. In an embodiment, a pitch angle of each of the vanes is set to coincide with a coal particle flow within the turret, approximately 65 degrees from horizontal. In an embodiment, the method may also include the steps of, with the vanes, dividing a swirling flow of coal as it enters the body of the turret into a plurality of controlled flows, and transporting the flows to the plurality of coal outlet pipes.

In yet another embodiment, a coal pulverizer is provided. The coal pulverizer includes a grinding mechanism configured to transform raw coal into pulverized coal, a classifier configured to receive the pulverized coal from the grinding platform and to generate a swirling flow of coal, the classifier being further configured to reject coarse particles of the pulverized coal from the swirling flow, a turret arranged generally above the classifier, the turret having a generally frusto-conical body and a plurality of static vanes arranged interior to the body and extending inwardly from an interior sidewall of the body, and a plurality of coal outlet pipes in fluid communication with the interior of the turret. The vanes of the turret configured to guide a swirling flow of coal as it enters the turret, and to divide the swirling flow into a plurality of controlled flows that are communicated to a plurality of coal outlet pipes. In an embodiment, the classifier includes a reject cone that is configured to receive the coarse particles rejected by the classifier and to transport the rejected coal particles to a grinding platform of the pulverizer. In an embodiment, the number of vanes is equal to the number of coal outlet pipes in the pulverizer. In an embodiment, each of the vanes includes a body having a leading edge and a trailing, wherein the leading edge is located adjacent to a bottom of the turret and the trailing edge is located adjacent to a top of the turret and a respective one of the coal outlet pipes. In an embodiment, the body of each of the vanes has a generally twisted shape, the twisted shape of the body of the vanes at the leading edge being configured to generally match the flow of coal at the bottom of the turret. In an embodiment, the leading edge is narrower than the trailing edge, and a pitch angle of each of the vanes is approximately 65 degrees from horizontal.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A coal pulverizer, comprising:

a grinding mechanism configured to transform raw coal into pulverized coal;

a classifier configured to receive the pulverized coal from the grinding mechanism and to generate a swirling flow of coal, the classifier being further configured to reject coarse particles of the pulverized coal from the swirling flow;

a turret arranged generally above the classifier, the turret having a frusto-conical body and a plurality of static vanes arranged interior to the body and extending inwardly from an interior sidewall of the body; and a plurality of coal outlet pipes in fluid communication with the interior of the turret;

wherein a body of each of the vanes has a twisted shape, a leading edge, and a trailing edge, the twisted shape of the body of the vanes at the leading edge being configured to generally match the flow of coal at a bottom of the turret, wherein the leading edge is narrower than the trailing edge, and wherein a pitch angle of each of the vanes is set to coincide with a coal particle flow within the turret, wherein the vanes are configured to guide the swirling flow of coal as it enters the turret, and to divide the swirling flow into a plurality of controlled flows that are communicated to a plurality of coal outlet pipes, wherein the number of vanes is equal to the number of coal outlet pipes in the pulverizer and wherein each of the leading edges is located adjacent to the bottom of the turret and each of the trailing edges is located adjacent to a top of the turret and a respective one of the coal outlet pipes.

2. The pulverizer of claim 1, wherein:

the classifier includes a reject cone that is configured to receive the coarse particles rejected by the classifier and to transport the rejected coal particles to a grinding mechanism of the pulverizer.

* * * * *